United States Patent [19]

Wilharm

[11] 4,382,538

[45] May 10, 1983

[54] VALVED LINED CONTAINER

[75] Inventor: Fred B. Wilharm, Cantonment, Fla.

[73] Assignee: St. Regis Paper Company, West Nyack, N.Y.

[21] Appl. No.: 190,923

[22] Filed: Sep. 26, 1980

[51] Int. Cl.[3] ..... B65D 30/26

[52] U.S. Cl. ..... 229/62.5; 229/55

[58] Field of Search ..... 220/462, 463, 416, 417, 220/460, 461; 229/17 R, 62.5, 55

[56] References Cited

U.S. PATENT DOCUMENTS

| | | | |
|---|---|---|---|
| 1,716,818 | 6/1929 | Hammond . | |
| 1,852,026 | 4/1932 | Redington . | |
| 1,951,011 | 3/1934 | Falk . | |
| 1,957,839 | 5/1934 | Lee . | |
| 1,968,487 | 7/1934 | Hayashi . | |
| 1,985,326 | 12/1934 | Orr . | |
| 2,038,544 | 4/1936 | Coty . | |
| 2,177,122 | 10/1939 | Tooker . | |
| 2,293,182 | 8/1942 | Vost | 220/463 |
| 2,360,720 | 10/1944 | Robinson . | |
| 2,396,565 | 3/1946 | Gardner | 229/55 X |
| 2,437,693 | 3/1948 | Hartman . | |
| 2,446,308 | 8/1948 | Smith | 220/463 |
| 2,493,337 | 1/1950 | Buttery | 220/463 |
| 2,817,474 | 12/1957 | Abramson . | |
| 2,864,549 | 12/1958 | Hayward et al. . | |
| 2,895,387 | 7/1959 | Robinson | 229/62.5 X |
| 2,904,241 | 9/1959 | Gorton et al. | 229/62.5 |
| 2,906,446 | 9/1959 | Williams | 229/62.5 |
| 2,968,432 | 1/1961 | Craishead . | |
| 2,982,461 | 5/1961 | Hultin | 220/460 X |
| 3,018,943 | 1/1962 | Keatins | 229/62.5 |
| 3,087,670 | 4/1963 | Rhodes . | |
| 3,113,712 | 12/1963 | Kindseth | 229/17 R X |
| 3,117,711 | 1/1964 | Camerini . | |
| 3,216,647 | 11/1965 | Arnold | 229/62.5 |
| 3,220,635 | 11/1965 | Kastins et al. . | |
| 3,248,042 | 4/1966 | Kastins et al. . | |
| 3,291,376 | 12/1966 | Goodwin . | |
| 3,306,522 | 2/1967 | Honsel . | |
| 3,355,997 | 12/1967 | Heimos et al. . | |
| 3,386,646 | 6/1968 | Arenbeck . | |
| 3,409,210 | 11/1968 | Barris et al. . | |
| 3,439,864 | 4/1969 | Kastins et al. . | |
| 3,466,981 | 9/1969 | Honsel . | |
| 3,473,446 | 10/1969 | Berghgracht . | |
| 3,688,650 | 9/1972 | de Vries . | |
| 3,902,652 | 9/1975 | Malcolm | 220/462 |
| 4,049,191 | 9/1977 | Stearley . | |
| 4,095,736 | 6/1978 | Rothschild et al. . | |

FOREIGN PATENT DOCUMENTS

| | | | |
|---|---|---|---|
| 684763 | 4/1964 | Canada | 383/56 |
| 358696 | 10/1931 | United Kingdom | 383/55 |

*Primary Examiner*—Allan N. Shoap
*Attorney, Agent, or Firm*—Joseph M. Maguire

[57] ABSTRACT

A valved lined container is disclosed. The container has an opening at one corner through which the liner valve protrudes. The liner valve is supported by an end flap of the container. The other corners of the container are reinforced. The liner may be filled, emptied and sealed by the protruding liner valve. The liner has an unstressed bottom seal. The liner is attached to the bag near all four width extending edges of the container with releasable glue.

6 Claims, 19 Drawing Figures

FIG. 3
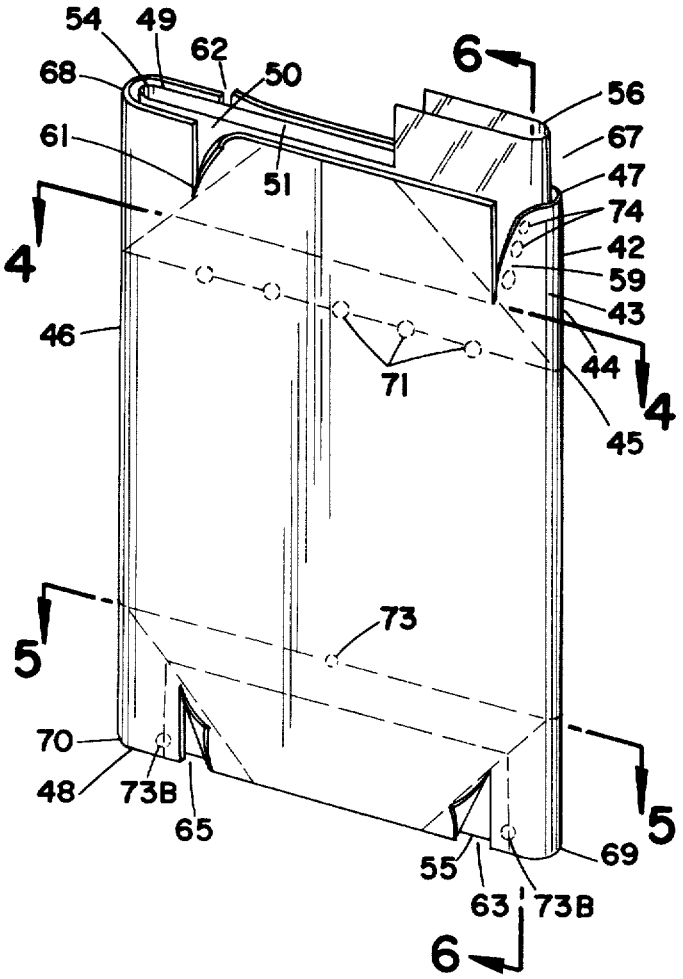
FIG. 6
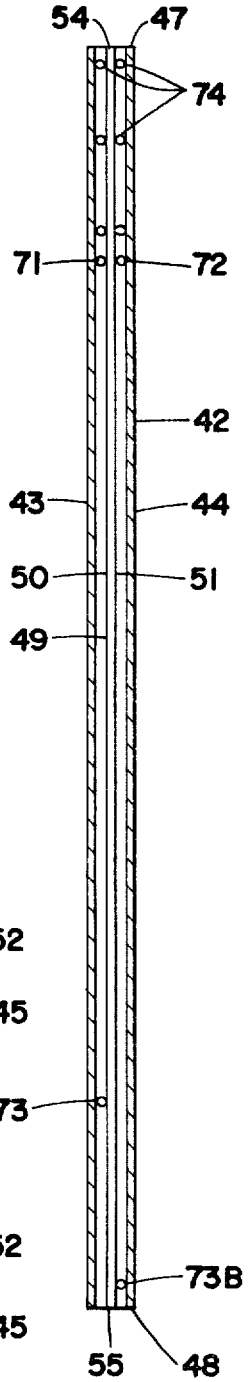
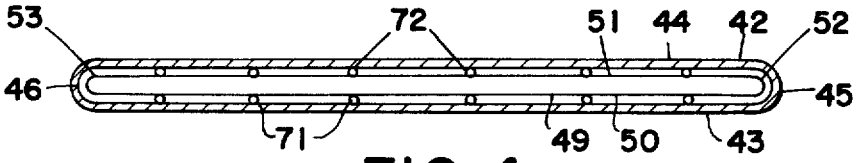
FIG. 4
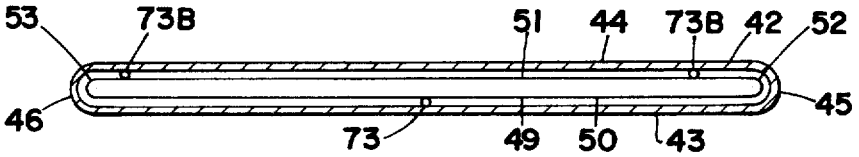
FIG. 5

FIG. 12
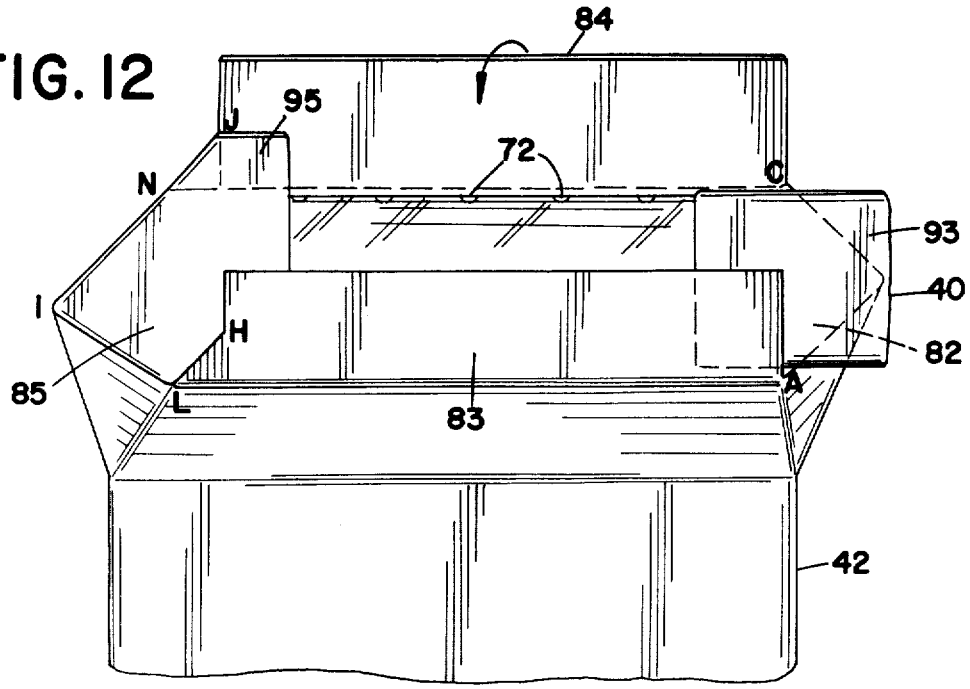
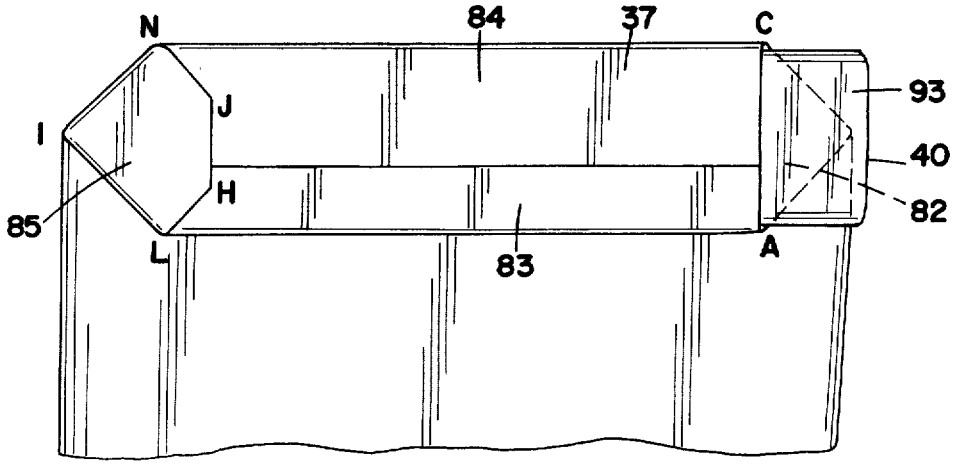
FIG. 13

VALVED LINED CONTAINER

This invention relates to an improved lined container.

In placing a commercial product into a bag the problem has previously existed that either a manufacturer had to compromise upon the bag in order to obtain easy closure and/or sealing or he had to be prepared to make a substantial investment in the machinery and space necessary for closing and sealing virgin bags.

Neither was satisfactory.

The improved lined container of this invention provides a manufacturer with an easy close and seal bag.

The improved lined container has an opening at one corner that allows for the filling and sealing of the contained liner after the fabrication of the bag.

This same opening also allows for the emptying and resealing of the contained liner at any time.

The improved lined container has glue holding the liner to the bag at the top. This glue eases fabrication of the bag. It also relieves certain stresses that would otherwise exist by causing the contained liner to move as a unit with the surrounding bag.

The improved lined container has glue holding the liner to the bag at the bottom. This feature in combination with the liner being longer than the height of the lined container relieves the stresses that would ordinarily exist on the bottom of the liner.

The improved lined container of this invention can be easily filled and sealed with relatively untrained personnel using simple tools.

The improved lined container of this invention can just as easily be opened, emptied and resealed.

The improved lined container of this invention lowers the cost of an automated bag filling line.

The liner of the improved lined container of this invention is releasable from within the bag. It can be removed and used separately as an independent unit without affecting its integrity in any way.

Other objects and a fuller understanding of the invention may be had by referring to the following description and claims, taken in conjunction with the accompanying drawings in which:

FIG. 3 is a perspective drawing of the cutting and gluing of the length of bag blank and contained liner of FIG. 2;

FIG. 4 is a sectional view of the top end of drawing of FIG. 3 taken along lines 4—4 of that figure;

FIG. 5 is a sectional view of the bottom end of the drawing of FIG. 3 taken along lines 5—5 of that figure;

FIG. 6 is a sectional view of the side of the drawing of FIG. 3 taken along lines 6—6 of that figure;

FIGS. 7–13 are a series of perspective drawings setting forth the folding and gluing of the top end of the improved lined container of FIG. 1;

Figure 1:
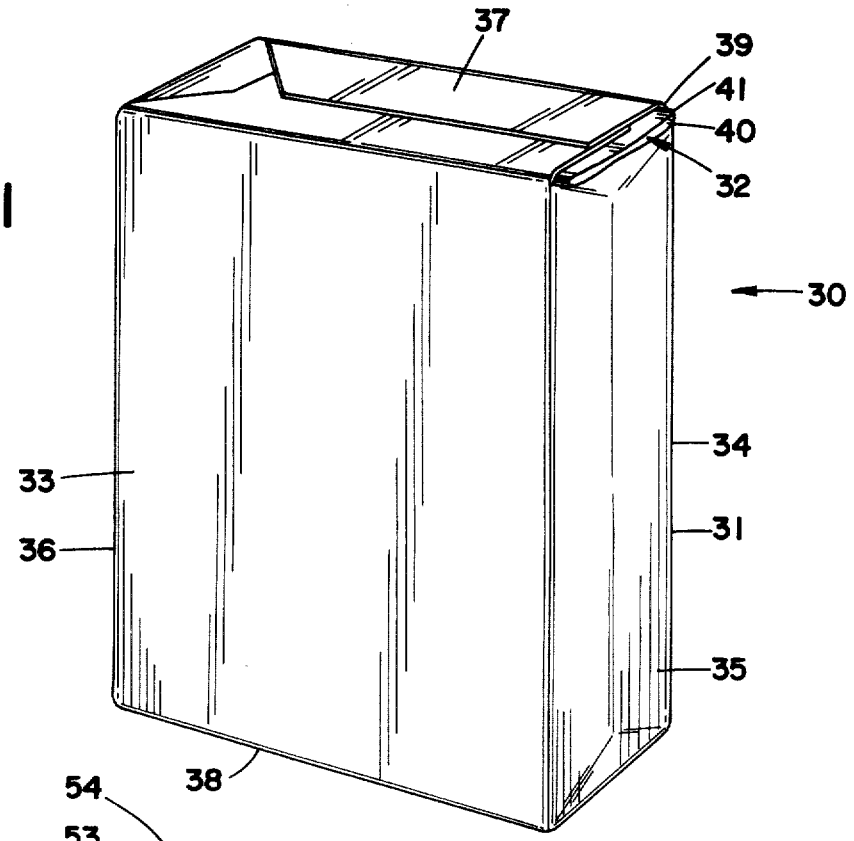
FIG. 1 is a perspective drawing of the expanded lined container built according to the teachings of this invention.

The invention of this application relates to a lined container (FIG. 1).

The lined container 30 is made up of a bag 31 in cooperation with a liner 32.

The bag 31 has a front 33, a back 34, first 35 and second 36 flattened sides, a top 37 and a bottom 38.

The bag 31 has a mouth opening 39 between the top 37 and the first flattened side 35.

A liner 32 is inside of the bag 31.

A valve extension 40 connected to the liner 32 protrudes out of the mouth opening 39 of the bag 31.

The liner 32 within the bag 31 can be filled, sealed, opened, emptied and resealed through this valve extension 40 without the integrity of the bag 31 being altered in any respect.

An overlay flap 41 glued to the top 37 of the bag 31 protects the valve extension 40 from material harm.

Figure 2:
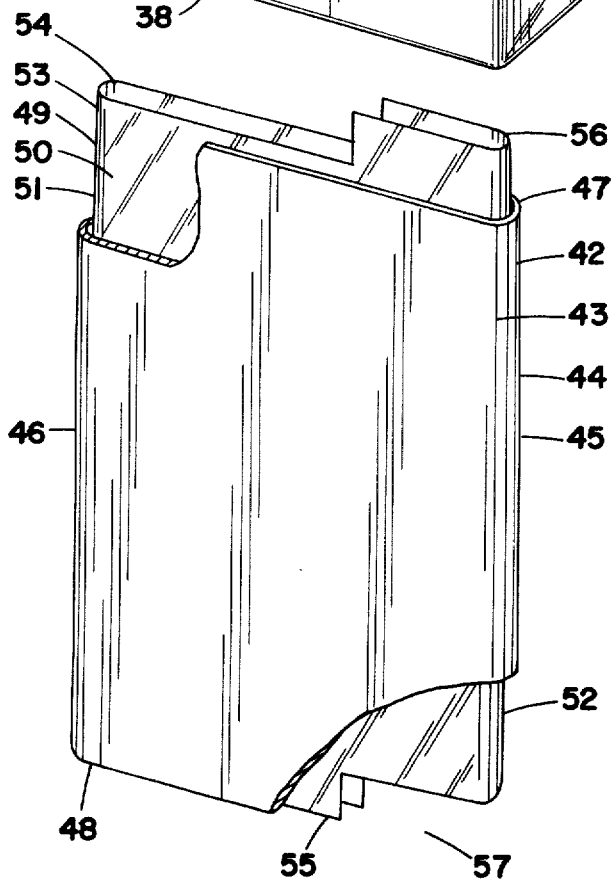
FIG. 2 is a perspective partially cut-away drawing of a length of bag blank and container liner used to build the lined container of FIG. 1.

The construction of the lined container 30 begins with a bag blank 42 and contained liner 49 (FIG. 2).

The bag blank 42 has a first side 43, a second side 44, two edges 45 and 46, a first end 47 and a second end 48. The first end 47 and second end 48 of the bag blank are open.

The length of the bag blank 42 is substantially equal to the height plus depth plus flap overlap of the ultimately sought lined container 30. The width of the bag blank 42 is substantially equal to the width plus depth of the ultimately sought lined container 30.

The bag blank 42 is made of a suitable bag material such as kraft paper. It may be single or multiply ply. The bag blank 42 could also be of a cardboard or plastic material, especially if a stronger more durable or boxed lined container 30 is desired.

The bag blank 42 contains a flattened tubular liner 49. The liner 49 has a first side 50, a second side 51, two edges 52 and 53, a first end 54 and a second end 55. The first end 54 and second end 55 of the liner 49 are open.

The liner 49 is cut to be substantially the same length and width as the bag blank 42. A small tab 56 may be provided extending from the first end 54 of the liner 49 to facilitate later operations. If a small tab 56 is provided and the liners are sequentially prepared from a continuous annular roll of tubular liner material (not shown) each liner 49 will have a corresponding notch 57 cut in its second end 55.

The liner 49 is made of a suitable liner material - preferably heat sealable such as plastic or paper coated with plastic on one side. Plain paper may also be used if an adhesive or sewn thread type seal is substituted for the heat sealing operations described herein.

The bag blank 42 is then slit and the liner 49 glued to it (FIGS. 3–6).

The bag blank 42 is slit with four pairs of slits. The slits extend substantially in a length direction from the ends 47–48 of the bag blank 42 and are oriented substantially perpendicular to the width direction of the bag blank 42.

Slit pairs 59, 60 and 61,62 are slit from the first end 47 of the bag blank 42. The top of slits 59 and 60 are substantially one half of the depth of the ultimately sought lined container 30 from a first corner 67 of the bag blank 42 along the first end 47 of the bag blank 42 and are each one half of the depth plus one half of the flap overlap of the ultimately sought lined container 30 in length.

Slit pairs 63,64 and 65,66 are slit from the second end 48 of the bag blank 42. The distance of the top of slits 61 and 62 from a second corner 68 of the bag blank 42 along the first end 47 of the bag blank 42, the distance of the bottom of slits 63 and 64 from a third corner 69 of the bag blank 42 along the second end 48 of the bag blank 42 and the distance of the bottom of slits 65 and 66 from a fourth corner 70 of the bag blank 42 along the second end 48 of the bag blank 42 are substantially equal to each other. This distance is ordinarily greater than the distance the top of slits 59,60 are from the first corner 67 of the bag blank 42. The length of slits 61, 62, 63, 64, 65 and 66 are substantially equal to each other. This length is ordinarily less than the length of slits 59,60.

To form a symmetrical bag the sum of the distance of any one of slits 61, 62, 63, 64, 65 and 66 from its respective corner of the bag blank 42 plus the length of the chosen slit is equal to the sum of the distance of the top of one of the slits 59 or 60 from the first corner 67 of the bag blank 42 plus the length of the chosen slit 59 or 60.

The liner 49 is glued to the bag blank 42 by glue lines 71, 72 and glue spots 73, 73B.

The first side 50 of the liner 49 is glued to the first side 43 of the bag blank 42 by width extending glue line 71 and glue spot 73 and the second side 51 of the liner 49 is glued to the second side 44 of the bag blank 42 by width extending glue line 72 and glue spots 73B.

Glue lines 71 and 72 are substantially a little more than one half the depth plus one half the flap overlap of the ultimately sought lined container 30 from the first ends 47 and 54 of the bag blank 42 and liner 49 respectively.

Glue lines 71 and 72 are each substantially equal in length to the width of the ultimately sought lined container 30. The ends of these width extending glue lines 71, 72 are substantially one half of the depth plus one half of the flap overlap of the ultimately sought lined container 30 from the respective adjoining edge pair 45,52 or 46,53.

Glue spot 73 is ordinarily substantially a little more than one half the depth plus one half of the flap overlap of the ultimately sought lined container 30 from the second ends 48 and 55 of the bag blank 42 and liner 49 respectively. Glue spots 73B are near the second ends 48 and 55 of the bag blank 42 and liner 49 respectively.

Glue spot 73 is substantially centered in respect to the edges 45,52 and 46,53 of the bag 42 and liner 49 respectively. Glue spots 73B are a little less than one half of the depth of the ultimately sought lined container 30 from the edges 45,52 and 46,53 of the bag 42 and liner 49 respectively.

The glue spot 73 can be reversed in position with glue spot 73B—glue spot 73 gluing the second side 51 of the liner 49 to the second side 44 of the bag blank and glue spots 73B gluing the first side 50 of the liner 49 to the first 43 of the bag blank 42.

These glue lines 71 and 72 and glue spots 73,73B ease the construction of the lined container 30 by facilitating the folding and positioning of the liner 49 during manufacturing operations. They also insure that the liner 49 is usually in an unstressed condition.

Optionally, the liner 49 may be glued to the bag blank 42 along slits 59 and 60 by glue 74. This glue would further facilitate the manufacture and use of the lined container 30.

Glues 71, 72, 73 and 74 may or may not be releasable glues.

Figure 7:
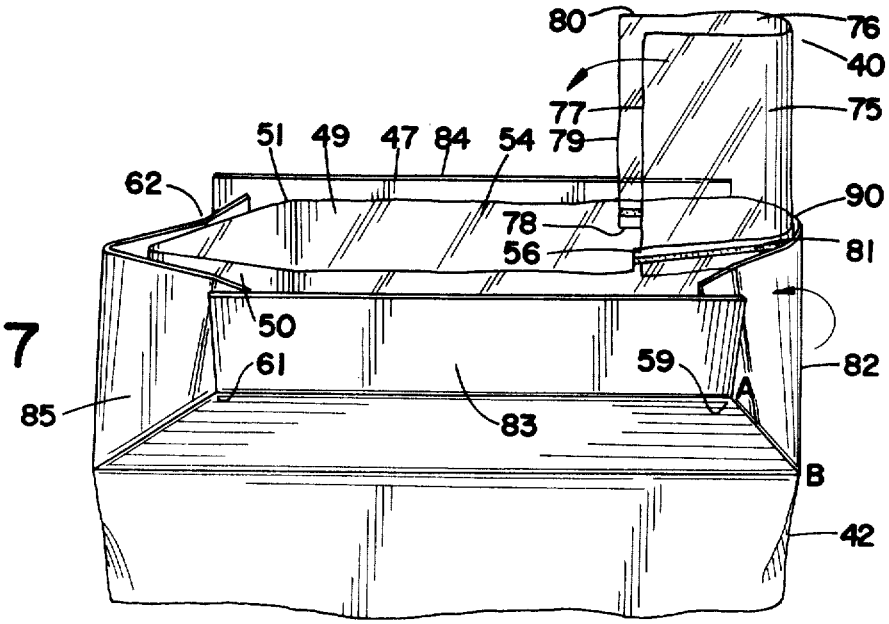

A valve extension 40 is attached to the liner tab 56 (FIG. 7).

The valve extension 40 has two surfaces 75 and 76 and four edges 77, 78, 79 and 80.

The valve extension 40 is sealed to the valve tab 56 along edge 78 by seal 81. Seal 81 is preferably a heat seal.

The valve extension 40 is preferably constructed of the same material as the liner 49. A valve extension 40 with outwardly turned long length edges 77 and 79 will seal in the ultimately constructed lined container 30 by means of a heat seal or other suitable closure seal. A valve extension 40 with inwardly turned short length edges 77 and 79 will seal in the ultimately constructed lined container 30 by a Filmlok* ® and/or other suitable seal.

*Registered trademark

Operations are performed upon the bag blank 42 and liner 49 as prepared to form the lined container of this invention. FIGS. 7–13 relate to the operations preformed to form the top 37 of the lined container 30 and FIGS. 14–17 relate to the operations preformed to form the bottom 38 of the lined container 30.

The top 37 of the lined container 30 is formed by a cooperation between the folding and gluing of the first end 47 of the bag blank 42 in combination with a folding and sealing of the first end 54 of the liner 49 (FIGS. 7–13).

The slitting and fold lines of the first end 47 of the bag blank 42 defines a valve support flap 82, first 83 and second 84 top flaps and a top side flap 85 (FIG. 7). The fold lines of the first end 54 of the liner 49 define a liner flap 87 and first 88 and second 89 top flaps (FIG. 8).

Figure 8:
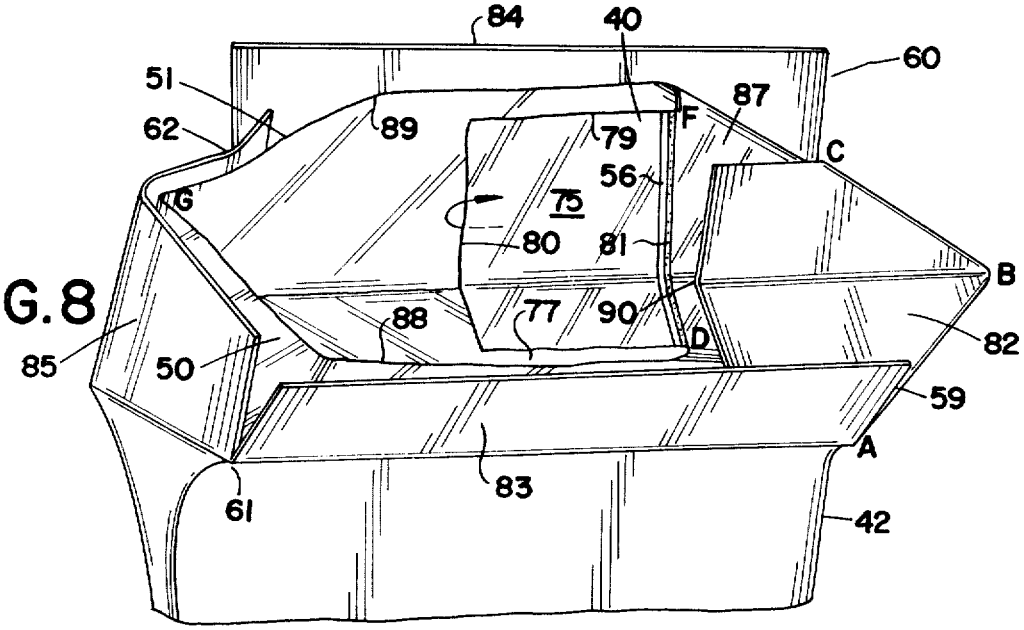

The valve support flap 82 and the liner flap 87 are folded inwardly along fold lines A-B-C and D-B-F respectively (FIG. 8). Point A is at the bottom of slit 59 and point C is at the bottom of slit 60.

Figure 9:
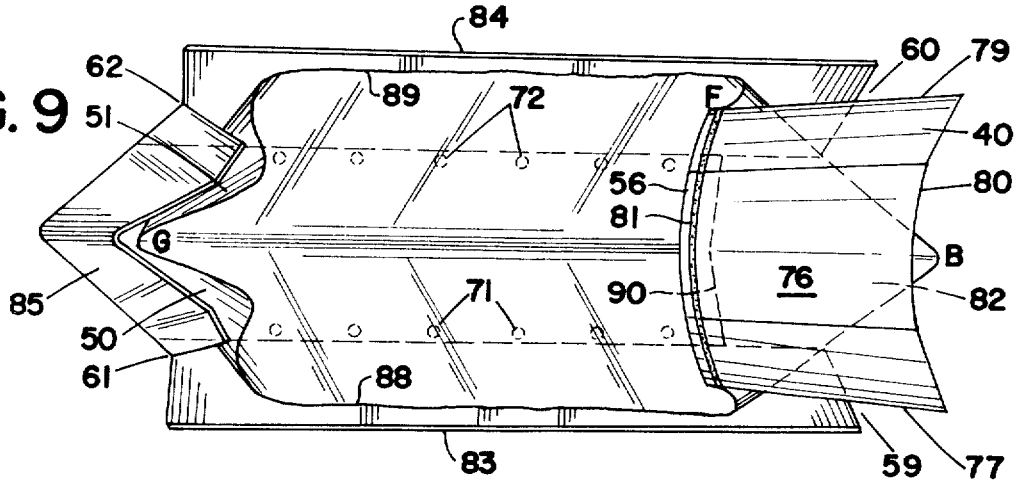

The valve extension 40 is pivoted generally around fold line D-F back over the valve support flap 82 (FIG. 9). The valve extension 40-liner tab 56-seal 81 is near and substantially parallel to edge 90 of the valve support flap 82. In an alternative configuration the valve extension 40 would not be pivoted around fold line D-F to overlay the valve support flap 82 but instead wound remain unpivoted as an extension of the valve support flap 82 much as shown in FIG. 8. At the completion of the remainder of the later disclosed folding and sealing steps this alternate configuration would form an inwardly extending valve for the top 37 of the lined container 30 instead of an outwardly extending valve.

Figure 10:
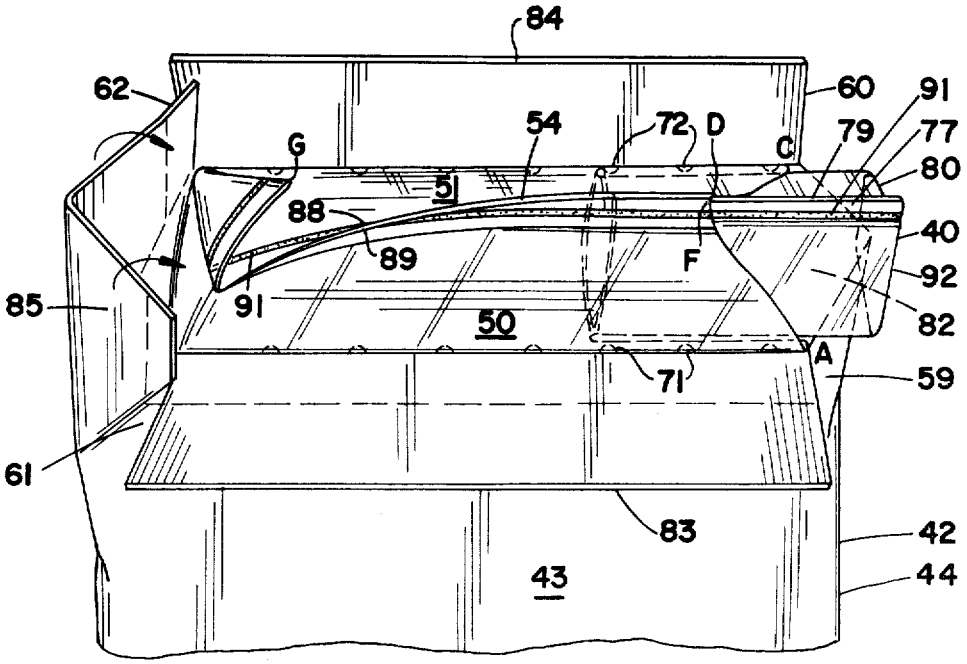

The first top flap 88 on the first side 50 of the liner 49 between points D and G is sealed to the second top flap 89 on the second side 51 of the liner 49 between points F and G and the first edge 77 of the valve extension 40 is sealed to the third edge 79 of the valve extension 40 by a single heatseal 91 (FIG. 10). The only access into the liner 49 through the first end 54 of the liner 49 is through the valve extension 40. The fourth edge 80 of the valve extension 40 defines an opening 92 into the first end 54 of the liner 49.

Figure 11:
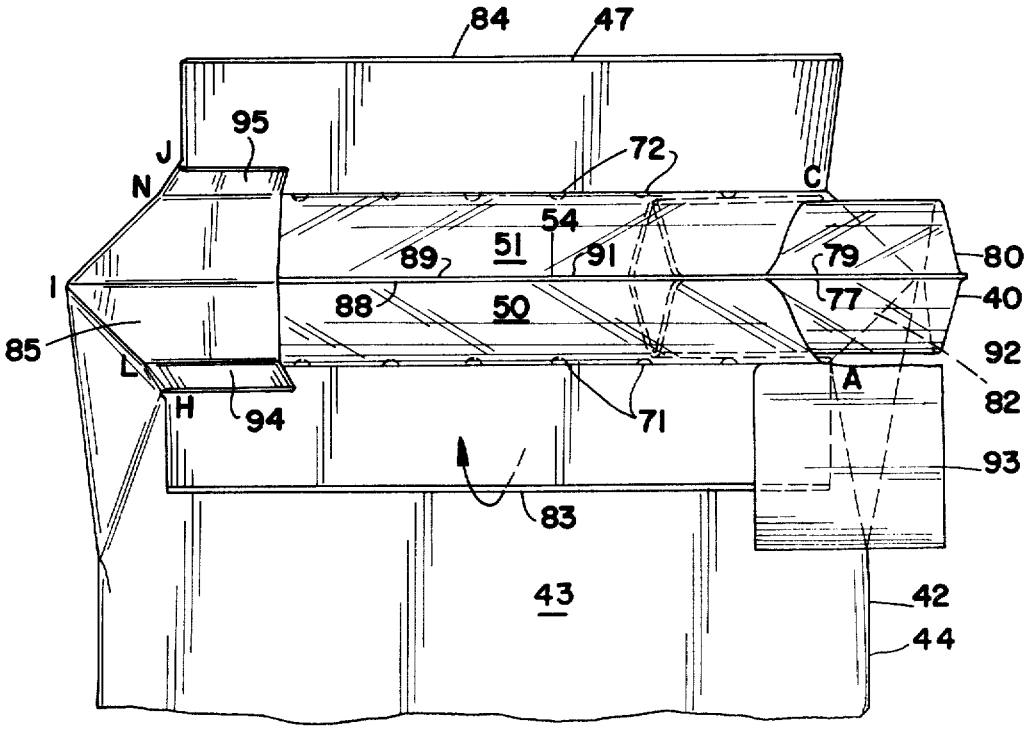

The top side flap 85 of the bag blank 42 is folded inwardly over point G on the first end 54 of the liner 49 around fold line H-I-J. Point H is at the bottom of slit 61 and point J is at the bottom of slit 62 (FIG. 11).

The folding of the valve support flap 82 and the first side flap 85 spreads the first 43 and second 44 sides of the bag blank 42 apart. The first 50 and second 51 sides of the liner 49 are also spread apart, they bring held to the first 43 and second 44 sides of the bag blank 42 by glue lines 71 and 72 respectively.

The first top flap 83 is folded inwardly over the first end 54 of the liner 49 around fold line A-L (FIG. 12).

Fold line A-L is one half the depth plus one half of the flap overlap of the ultimately constructed lined container from the first end 47 of the bag blank 42. Fold line A-L intersects the bottom of slit 59. A valve protection flap 93 may be glued to the valve support flap 82 end of the first top flap 83. When the first top flap 83 is folded inwardly the valve protection flap 93 would cover the valve extension 40 to protect the valve extension 40 from physical or environmental harm during shipping and usage.

The folding of the top side flap 85 and first top flap 83 in combination with the unsymmetrical slitting of the bag blank 42 (contrast slits 59, 60 with slits 61, 62, 63, 64 and 65, 66) creates reinforcing tab 94.

The second top flap 84 is folded inwardly over the first top flap 83 and the first end 54 of the liner 49 around fold line C-N (FIG. 12). Fold line C-N is one half of the depth plus one half of the flap overlap of the ultimately constructed lined container from the first end 47 of the bag blank 42. Fold line C-N intersects the bottom of slit 60.

The folding of the top side flap 85 and the second top flap 82 in combination with the unsymmetrical slitting of the bag blank 42 creates reinforcing tab 95.

The first top flap 83 and the second top flap 84 are glued together to complete the top 37 of the lined container 30 (FIG. 13).

The bottom 38 of the lined container is formed by a cooperation of the folding and gluing of the second end 48 of the bag blank 42 in combination with a folding and sealing of the second end 55 of the liner 48 (FIGS. 14–17).

Figure 14:
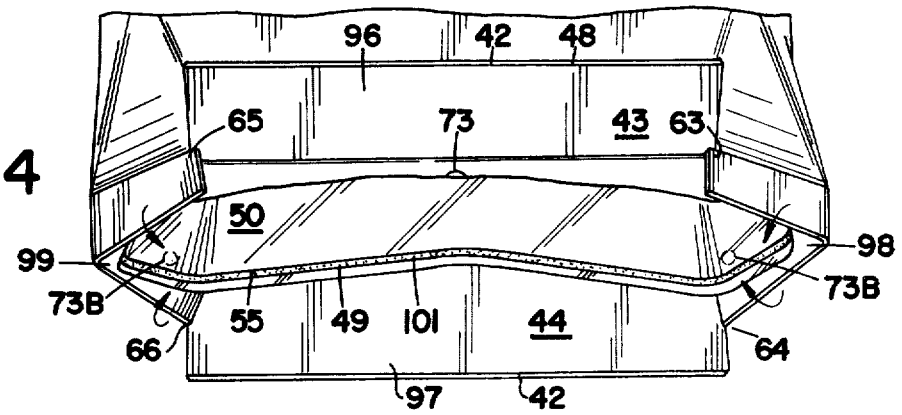
FIGS. 14–17 are a series of perspective drawings setting forth the steps of folding and gluing the bottom end of the improved lined container of FIG. 1.

The slitting and fold lines of the second end 48 of the bag blank 42 defines a first 96 and second 97 bottom flap and a first 98 and second 99 bottom side flap (FIG. 14).

The second end 55 of the liner 49 is sealed by heatseal 101.

Figure 15:
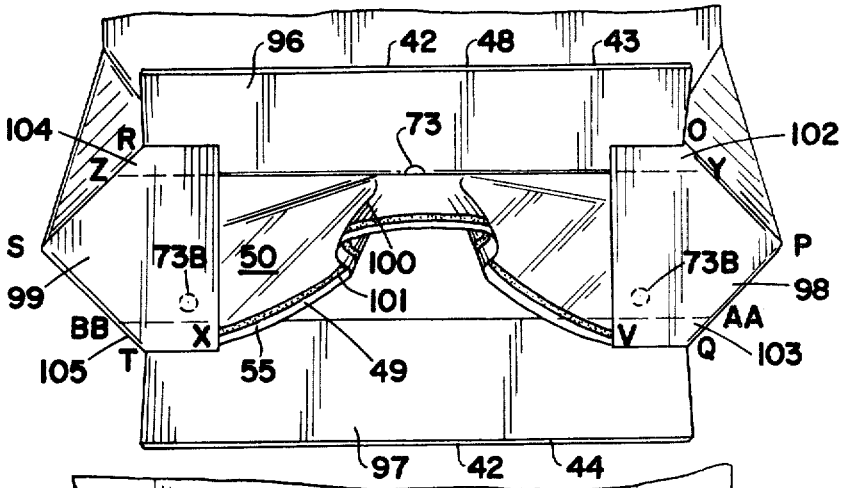

The first 98 and second 99 bottom side flaps are folded inwardly over the second end 55 of the liner 49 along fold lines O-P-Q and R-S-T respectively (FIG. 15). Point O is at the bottom of slit 63. Point Q is at the bottom of slit 64. Point R is at the bottom of slit 65 and point T is at the bottom of slit 66.

The folding of the first 98 and second 99 bottom side flaps spreads the first 43 and second 44 sides of the bag blank 42 apart. The fact that the first side 50 of the liner 49 is held to the first side 43 of the bag blank 42 by glue spot 73 in combination with the folding of the first 98 and second 99 bottom side flaps folds the liner 49 along fold line Y-Z to define a bottom section 100. The bottom corners of the liner are folded along fold line P-V and S-X respectively.

Figure 16:
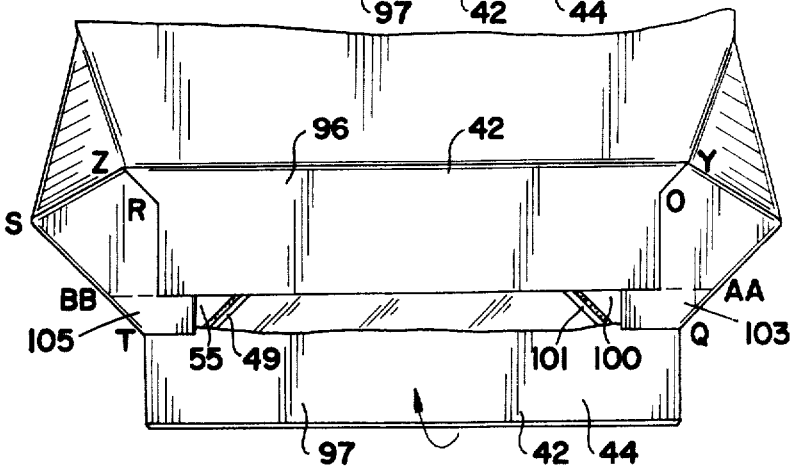

The first bottom flap 96 of the liner 49 is folded inwardly over the second end 55 of the liner 49 around fold line Y-Z to overlay the bottom section 100 of the liner 49 (FIG. 16).

Fold line Y-Z is one half of the depth plus one half of the flap overlap of the ultimately constructed lined container from the second end 48 of the bag blank 42. This in combination with the shorter length of slits 63 and 65 creates reinforcing tabs 102 and 104.

The second bottom flap 97 is folded inwardly over the first bottom flap 96 and the bottom section 100 of the liner 49 around fold line AA-BB.

Fold line AA-BB is one half of the depth plus one half of the flap overlap of the ultimately constructed lined container from the second end 48 of the bag blank 42. This in combination with the shorter length of slits 64 and 66 creates reinforcing tabs 103 and 105.

Figure 17:
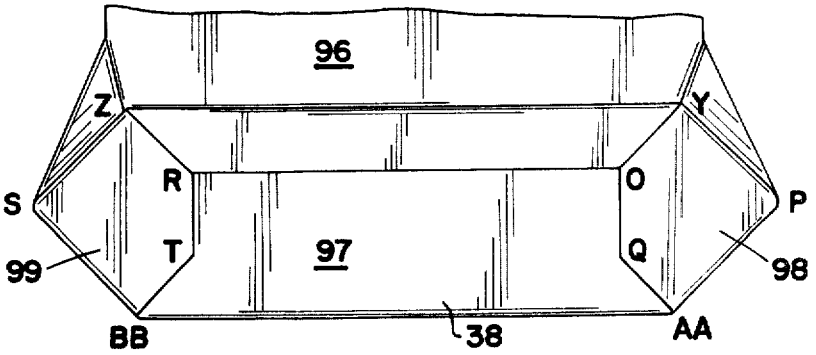

The first bottom flap 96 and the second bottom flap 97 are glued together to complete the bottom 38 of the lined container 30 (FIG. 17). The bottom section 100 of the liner 49 is in a flattened condition inside of the bottom 38 of the lined container with the heatseal 101 near fold line AA-BB.

The lined container 30 is shipped to a manufacturer for his use in a flattened condition with a top 37 and a bottom 38 in the general shape as disclosed by FIGS. 13 and 17 respectively.

The manufacturer fills the lined container 30 with his product through the valve extension 40. As the lined container 30 fills it expands until eventually it has the general shape as disclosed by FIG. 1.

At this time the lined container 30 is expanded. The top 37 and bottom 38 of the lined container 30 are no longer in the flattened condition of FIGS. 13 and 17 respectively.

Figure 18:
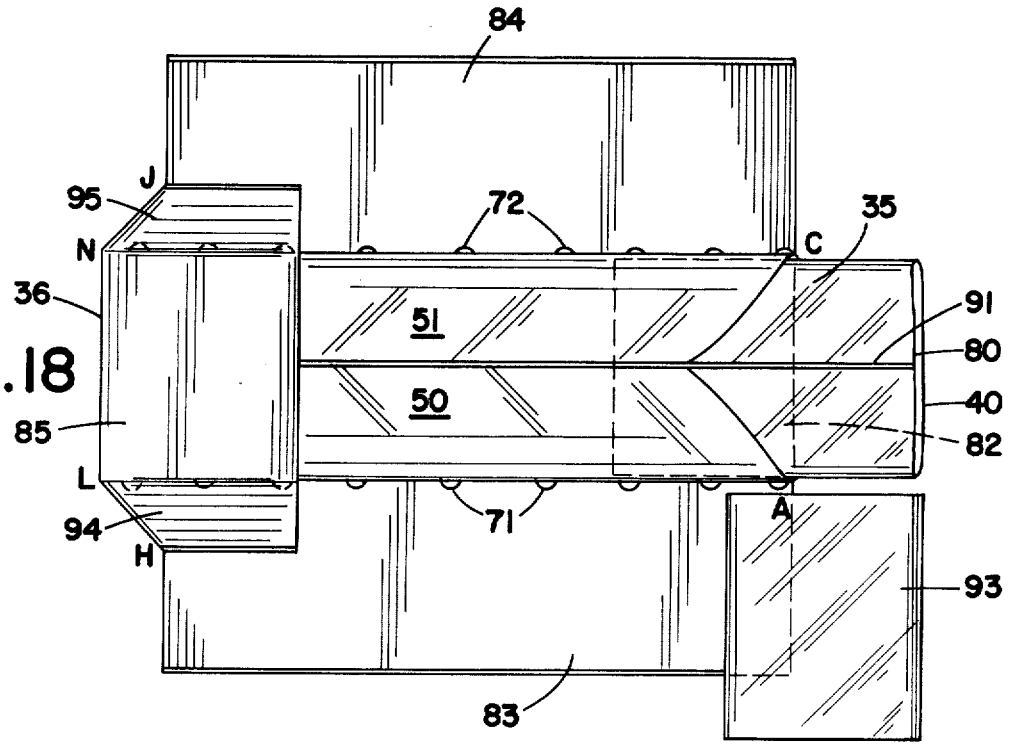
FIG. 18 is a partially unfolded end-on drawing of the top end of the lined container of FIG. 1.

At the top 37 of the lined container 30 the valve support flap 82 is connected to the first flattened side 35 of the lined container 30 by a first depth extending fold line A-C (FIG. 18). The top side flap 85 is connected to the second flattened side 36 of the lined container 30 along second depth extending fold line L-N. The first top flap 83 is connected to the front 33 of the lined container 30 along a first laterally extending fold line A-L. The second top flap 84 is connected to the back 34 of the lined container 30 along a second laterally extending fold line C-N.

The reinforcing tabs 94 and 95 connect the first top side flap 85 with the first 83 and second 84 top flaps of the lined container 36 respectively.

The valve extension 40 overlays the valve support flap 82.

The valve protection flap 93 shields the valve extension 40.

Figure 19:
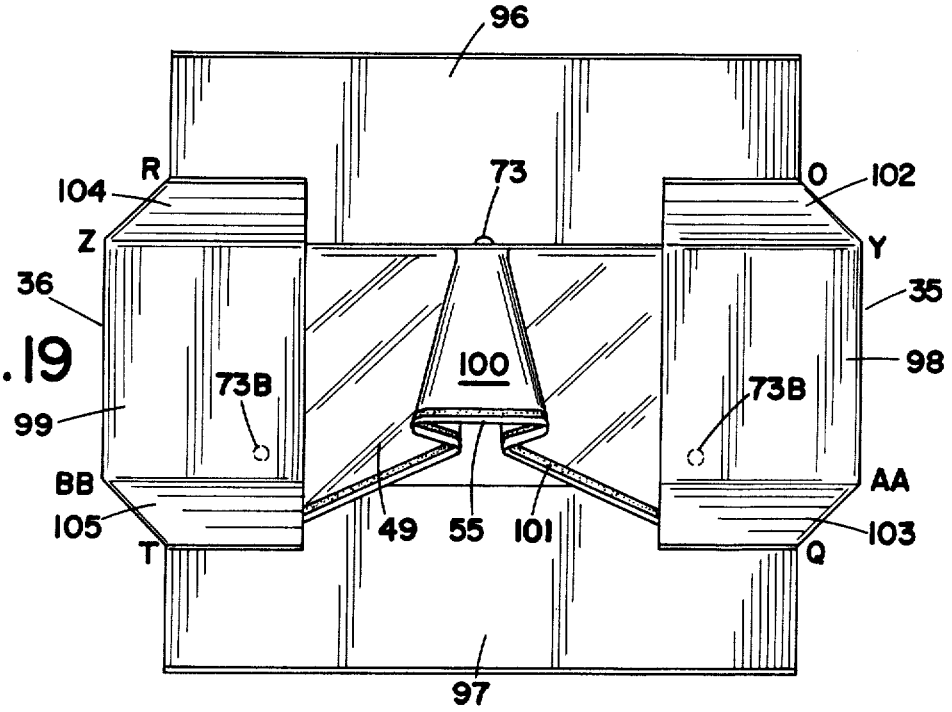
FIG. 19 is a partially unfolded end-on drawing of the bottom end of the lined container of FIG. 1.

At the bottom 38 of the lined container 30 the first bottom side flap 98 is connected to the first flattened side 35 of the lined container 30 by a third depth extending fold line AA-Y (FIG. 19). The second bottom side flap 99 is connected to the second flattened side 36 of the lined container 30 along a fourth depth extending fold line BB-A. The first bottom flap 96 is connected to the front 33 of the lined container 30 along a third laterally extending fold line Y-Z. The second bottom flap 97 is connected to back 34 of the lined container along a fourth laterally extending fold line AA-BB.

Reinforcing tabs 102 and 104 connect the first bottom flap 96 to the first 98 and second 99 bottom side flaps respectively. Reinforcing tabs 103 and 105 connect the second bottom flap 97 to the first 98 and second 99 bottom side flaps respectively.

The bottom section 100 of the liner 49 lies along the bottom 38 of the lined container 30. Seal 101 is near the fourth laterally extending fold line AA-BB.

Glue lines 71,72 and glue spots 73,73B coordinate the expansion of the liner with the outer bag material and to facilitate the filling operation.

The length of the liner 49 including its bottom section 100 reduces the stress at the bottom.

The manufacturer seals and ships the lined container 30. The seal may be a Filmlok* 200 seal, a heat seal, sewn seal or other sealing of the protruding section of the valve extension 40.

*Registered trademark

The customer of the product within the lined container 30 can obtain access to the product through the valve extension 40 without having to disturb the overall integrity of the lined container 30.

The customer can use the lined container 30 as a dispensing medium.

The customer can open and reseal the lined container 30.

Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and the scope of the invention as hereinafter claimed.

What is claimed is:

1. A multiwall bag including an outer tube of nonheat sealable material formed at both ends with closures and having opposing flattened sides; an inner tube of heat sealable material having intermediate portions circumferentially and releasably bonded to the outer tube for manual detachment therefrom, a portion of its circumferential edge surface at one end at a corner formed with a flap, the remainder of its circumferential edge surface at the one end heat sealed to closure, and its opposite end heat sealed to closure; the outer tube closure at the one end comprising two opposing corner flaps and two opposing side flaps formed by cutting longitudinal slits in the flattened sides; one of the outer tube corner flaps constituting a valve support flap connected to and extending between the flattened sides and disposed intermediate the side flaps and the inner tube corner flap and cooperating with the side flaps to form a valve opening into the bag; a valve extension of heat sealable material in the valve opening connected by heat sealing to the inner tube corner flap and having side edges heat sealed together to form a tubular passage opening to the interior of the inner tube for filling the inner tube with the outer tube closures in their closed positions, the inner tube closure at the one end being separate from the outer tube closure at the corresponding end and being formed by the heat sealed side edges of the valve extension and said heat sealed circumferential edge surface at the one end, the inner tube closure at the opposite end being separate from the outer tube closure at the corresponding end.

2. The bag of claim 1 wherein the valve extension is folded back over and contiguous to the valve support flap and the tubular passage extends outside the valve opening.

3. The bag of claim 2 wherein a valve protection flap is secured to one of the side flaps and disposed intermediate the one side flap and the valve extension.

4. The bag of claim 3 wherein the inner tube at a position adjacent the one end is bonded to the outer tube flattened sides and at a position adjacent the opposite end to one of the flattened sides.

5. The bag of claim 4 wherein the outer tube closure at the opposite end comprises two opposing corner flaps and two opposing side flaps formed by cutting longitudinal slits in the flattened sides.

6. The bag of claim 5 wherein the opposite end of the inner tube lies substantially next to the juncture of one of the flattened sides and one of the opposing side flaps of opposite end of the outer tube.

* * * * *